US007059890B2

(12) United States Patent
Donhauser

(10) Patent No.: US 7,059,890 B2
(45) Date of Patent: Jun. 13, 2006

(54) DEVICE FOR CONTACTING AN ELECTRICAL CONDUCTOR

(75) Inventor: Peter Donhauser, Amberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/007,481

(22) Filed: Dec. 8, 2004

(65) Prior Publication Data

US 2005/0124205 A1 Jun. 9, 2005

(30) Foreign Application Priority Data

Dec. 8, 2003 (EP) ..... 03028177

(51) Int. Cl.
*H01R 13/56* (2006.01)

(52) U.S. Cl. ..... 439/409; 439/406; 439/407; 439/410

(58) Field of Classification Search ..... 439/409, 439/410, 406, 407, 417
See application file for complete search history.

(56) References Cited

U.S. PATENT DOCUMENTS

| | | | | |
|---|---|---|---|---|
| 3,964,816 | A * | 6/1976 | Narozny | 439/397 |
| 4,427,253 | A * | 1/1984 | Smith et al. | 439/413 |
| 4,682,835 | A * | 7/1987 | Aujla et al. | 439/395 |
| 4,915,645 | A * | 4/1990 | Konnemann et al. | 439/417 |
| 5,338,220 | A * | 8/1994 | Soes et al. | 439/403 |
| 5,356,307 | A * | 10/1994 | Dechelette | 439/421 |
| 5,669,785 | A * | 9/1997 | Hammer et al. | 439/396 |
| 5,951,321 | A * | 9/1999 | Jaag | 439/405 |
| 6,152,760 | A * | 11/2000 | Reeser | 439/409 |
| 6,296,515 | B1 | 10/2001 | Daoud | |
| 6,527,580 | B1 * | 3/2003 | Süss et al. | 439/417 |
| 6,811,430 | B1 * | 11/2004 | Carrico et al. | 439/409 |

FOREIGN PATENT DOCUMENTS

| | | |
|---|---|---|
| DE | 198 35 459 A1 | 2/2000 |
| DE | 100 39 963 C2 | 3/2002 |

* cited by examiner

*Primary Examiner*—Tulsidas C. Patel
*Assistant Examiner*—Harshad Patel

(57) ABSTRACT

The invention relates to a device for contacting an electrical conductor, having a base body (1), having a closing element (2) with a receptacle area (3) for receiving the conductor, having an insulation piercing connector (4) held in the base body (1) with a contact region (5), wherein the closing element (2) is movable in a linear direction from an open position to a closed position relative to the base body (1), with the insulation piercing connector (4) being disposed such that its contact region (5) is located outside of the receptacle area (3) relative to the closing element (2) in the open position and inside the receptacle area (3) relative to the closing element (2) in the closed position. In order to improve the device it is proposed that a rocker element (6) and an actuating element (7) are provided, with the rocker element (6) being movably mounted in the base body (1) and disposed relative to the closing element (2) and actuating element (7) in such a way that a linear movement of the closing element (2) from the open position to the closed position can be converted into a linear movement of the actuating element (7) in the opposite direction and that a linear movement of the actuating element (7) can be converted into a linear movement of the closing element (2) from the closed position to the open position in the opposite direction.

14 Claims, 3 Drawing Sheets

DEVICE FOR CONTACTING AN ELECTRICAL CONDUCTOR

CROSS REFERENCE TO RELATED APPLICATIONS

This application claims priority to the European application 03028177.8 EP filed Dec. 8, 2003 and which is incorporated by reference herein in its entirety.

FIELD OF INVENTION

The invention relates to a device for contacting an electrical conductor, having a base body, having a closing element with a receptacle area for receiving the conductor, having an insulation piercing connector held in the base body with a contact region, wherein the closing element is movable in a linear direction from an open position to a closed position relative to the base body, with the insulation piercing connector being disposed such that its contact region is located outside of the receptacle area relative to the closing element in the open position and inside the receptacle area relative to the closing element in the closed position.

BACKGROUND OF INVENTION

A device of this kind for contacting an electrical conductor is known from DE 100 39 963 C2. The object of the present invention is to specify an improved device for contacting an electrical conductor.

SUMMARY OF INVENTION

This object is achieved by a device with the features recited in the Claims. According to the invention, a rocker element and an actuating element are provided in a generic device for contacting an electrical conductor, with the rocker element being movably mounted in the base body and disposed relative to the closing element and actuating element in such a way that a linear movement of the closing element from the open position to the closed position is converted into a movement of the actuating element in the opposite direction and that a linear movement of the actuating element is converted into a linear movement of the closing element from the closed position to the open position in the opposite direction.

Compared to conventional insulation piercing connecting devices the device according to the invention can be embodied in a particularly space-saving manner. As a result a connector can be implemented in insulation piercing connector technology which has no greater dimensions than a regular connector implemented in conventional screw-type or spring-loaded technology.

Further advantageous embodiments and preferred developments of the device according to the invention are described in the dependent Claims.

The contacting of an electrical conductor can be effected particularly reliably if the insulation piercing connector has a steel overspring. Said steel overspring serves to stabilize the cutting and contact regions of the insulation piercing connector and enables the pressure exerted by said insulation piercing connector on the introduced conductor to be increased.

According to an advantageous embodiment of the invention, the device is provided for a 1- to n-row arrangement in a connector receptacle housing (where n=natural number).

A cable storage space is advantageously provided ahead of the receptacle area in order to protect the introduced conductors.

BRIEF DESCRIPTION OF THE DRAWINGS

The invention will be described and explained in more detail below with reference to the exemplary embodiments depicted in the figures, in which.

DETAILED DESCRIPTION OF INVENTION

Figure 1:
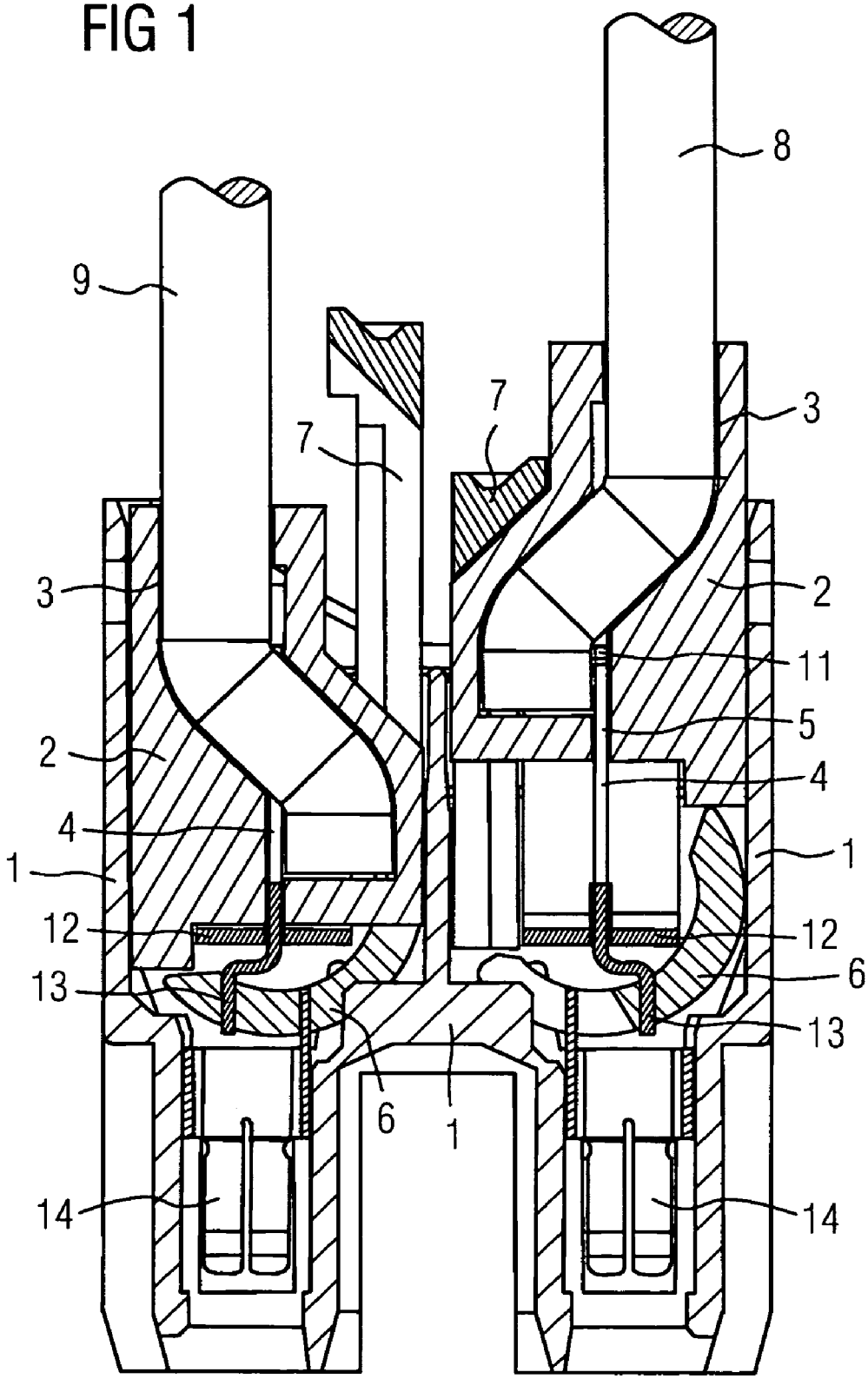
FIG. 1 shows an insulation piercing connecting device in the closed and open state respectively.

FIG. 1 shows two insulation piercing connecting devices in a common base body 1. The insulation piercing connecting device shown on the right-hand side of FIG. 1 is in the open state, whereas the insulation piercing connecting device shown on the left-hand side of FIG. 1 is in the closed state. The insulation piercing connecting devices each have a closing element 2 which is movable in a linear direction within the base body 1. This closing element 2 has a receptacle area 3 for receiving an electrical conductor 8, 9. An insulation piercing connector 4 with a contact region 5 is held in a stationary position in the base body 1 in each case. The mechanical design of an insulation piercing connector 4 of said kind is shown in the exemplary embodiment according to FIG. 3. A rocker element 6 is mounted or guided in the base body 1 such that it touches one end of the closing element 2 on the one hand and one end of an actuating element 7 on the other. The rocker element 6 is disposed relative to the closing element 2 and actuating element 7 in such a way that a linear movement of the closing element 2 from the open position to the closed position is converted into a linear movement of the actuating element 7 in the opposite direction and a linear movement of the actuating element 7 is converted into a linear movement of the closing element 2 from the closed position to the open position in the opposite direction.

In order for an electrical conductor 8, 9 to make electrical contact, said conductor is introduced into the receptacle area 3 of the closing element 2. In the exemplary embodiment according to FIG. 1, said receptacle area 3 is configured in such a way that upon being introduced the conductor 8, 9 is forced to make a twofold change of direction. In this arrangement the respective optimal geometry of the receptacle area 3 of the closing element 2 is dependent on the implementation of the conductor 8, 9 to be contacted, in particular on its flexibility and structure. The receptacle area 3 is clearly delimited spatially so that on the one hand the electrical conductor 8, 9 is guided in a specific manner and on the other hand can be introduced only as far as a certain stop. If an electrical conductor 8, 9 has been fully introduced into the receptacle area in the open position of the closing element 2, the closing element 2 together with the introduced conductor 8, 9 can be moved linearly from the open position to the closed position in order to contact the conductor 8, 9. Said linear movement of the closing element 2 from an open to a closed position is caused by appropriate pressure on the upper end of the closing element 2 or, as the case may be, conductor 8, 9, with the aid of a tool if necessary. A commercially available screwdriver, for example, can be used as an actuating tool. The closing element 2 is embodied such that it touches the rocker element 6 in a lower area. The linear movement of the closing element 2 from top to bottom therefore leads to a movement of the rocker element 6. The rocker element 6 is mounted or guided in the base body 1 in such a way that the linear movement of the contact point between the closing element 2 and an end area of the rocker element 6 caused by the closing element 2 leads to a linear movement of the contact point between the opposite end area of the rocker element 6 and actuating element 7 in the opposite direction. Thus, to the extent that the closing element 2 is moved linearly in one direction, the actuating element 7 is moved linearly in the opposite direction due to the conversion of the movement by the rocker element 6. The linear movements of the closing element 2 and the actuating element 7 are therefore coupled in opposition via the rocker element 6. The rocker element 6 according to the exemplary embodiment shown in FIG. 1 is implemented as part of a hollow cylinder and is movably mounted within the base body 1 in such a way that it can execute a circular movement about the imaginary center of the hollow cylinder. Other embodiments of the rocker element are equally possible. It can take the form, for example, of a rocker rotatably mounted on a pivoting point and having two legs or, as the case may be, lever arms whose ends touch the closing element 2 and the actuating element 7 respectively. In a rocker with lever arms of unequal length, the ratio between travel and force can be optimally adjusted in each case for the closing and opening action.

Figure 3:
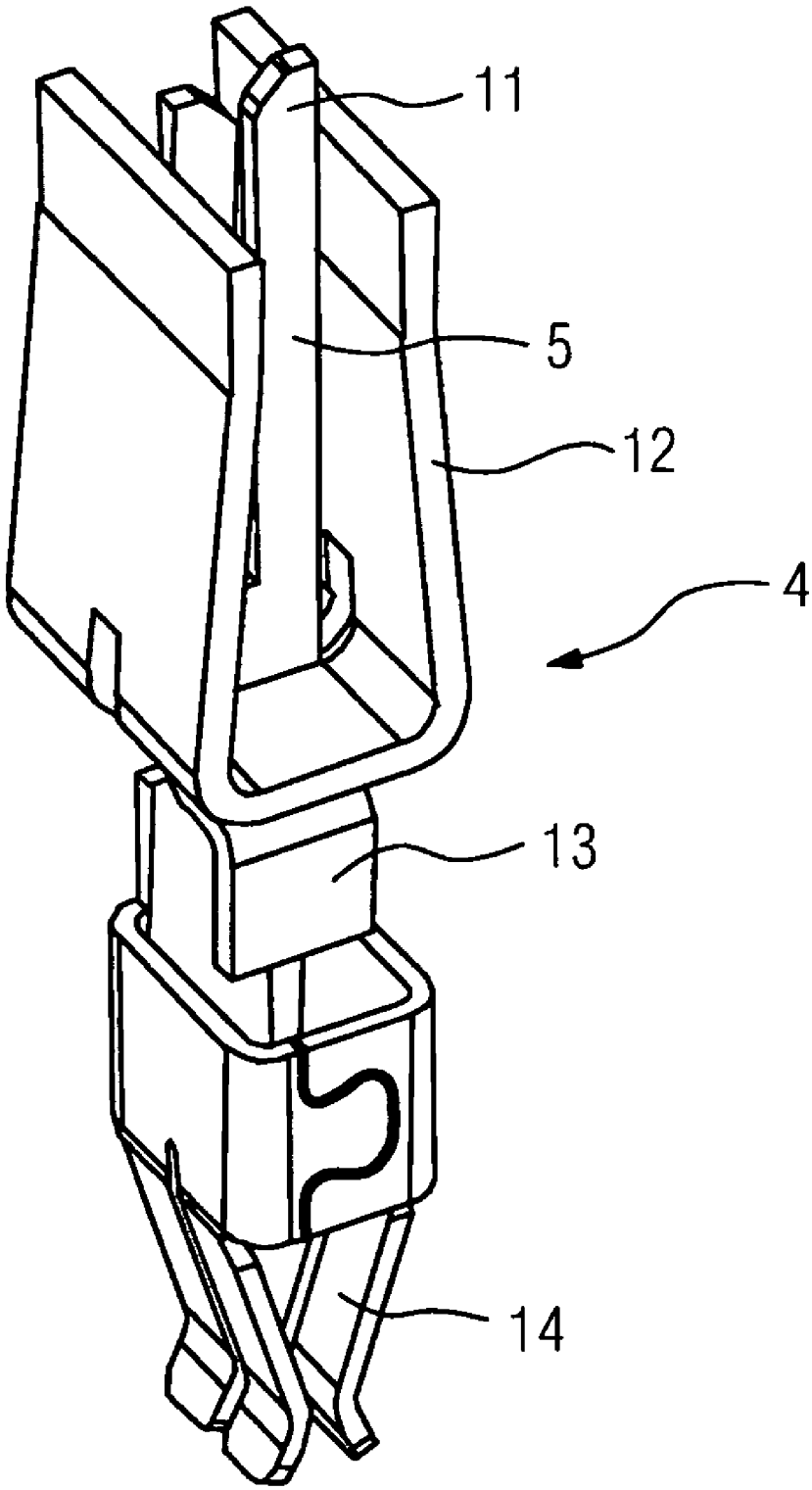
FIG. 3 shows an insulation piercing connector.

Owing to the linear movement of the closing element 2 or of the conductor 8, 9, the receptacle area 3 of the closing element 2 moves in relation to the stationary insulation piercing connector 4 in such a way that the contact region 5 of the insulation piercing connector 4 penetrates into the receptacle area 3 and consequently into the conductor 8, 9. The left-hand side of FIG. 1 shows a conductor 9 within the receptacle area 3 of a closing element 2 in the closed state. The electrical conductor 9 is contacted by the contact region 5 of the closing connector 4. In order to achieve an electrical contact between contact region 5 of the insulation piercing connector 4 and the inner conductor or inner conductors of the electrical conductor 8, 9, the insulation piercing connector has a cutting area for penetrating the insulation of the electrical conductor 8, 9 as well as a contact region 5 for establishing electrical contact with the inner conductor or conductors. An exemplary embodiment of an insulation piercing connector 4 of this type is shown in FIG. 3. Electrical contact of the electrical conductor 8, 9 is thus reliably established in the closed state of the insulation piercing connecting device.

In order to be able to break the contacting of the electrical conductor 8, 9 again and to withdraw the electrical conductor 8, 9 from the insulation piercing connecting device, the actuating element 7 is moved during an opening action linearly in the opposite direction compared to the previously described closing action. Said movement of the actuating element 7 is caused by pressure on the upper end of the actuating element 7, with the aid of a suitable tool if necessary. Analogously to the conversion of the linear movement during the closing action, the linear movement of the actuating element 7 now running in the opposite direction is again converted by the rocker element 6 into a linear movement of the closing element 2 from the closed position to the open position in the corresponding opposite direction. In the process the electrical contact between the electrical conductor 8, 9 and the insulation piercing connector 4 is broken again and at the end of the opening action the electrical conductor 8, 9 can be removed from the receptacle area 3 of the closing element 2. At the end of the opening action the insulation piercing connecting device is once again in the open position.

Figure 2:
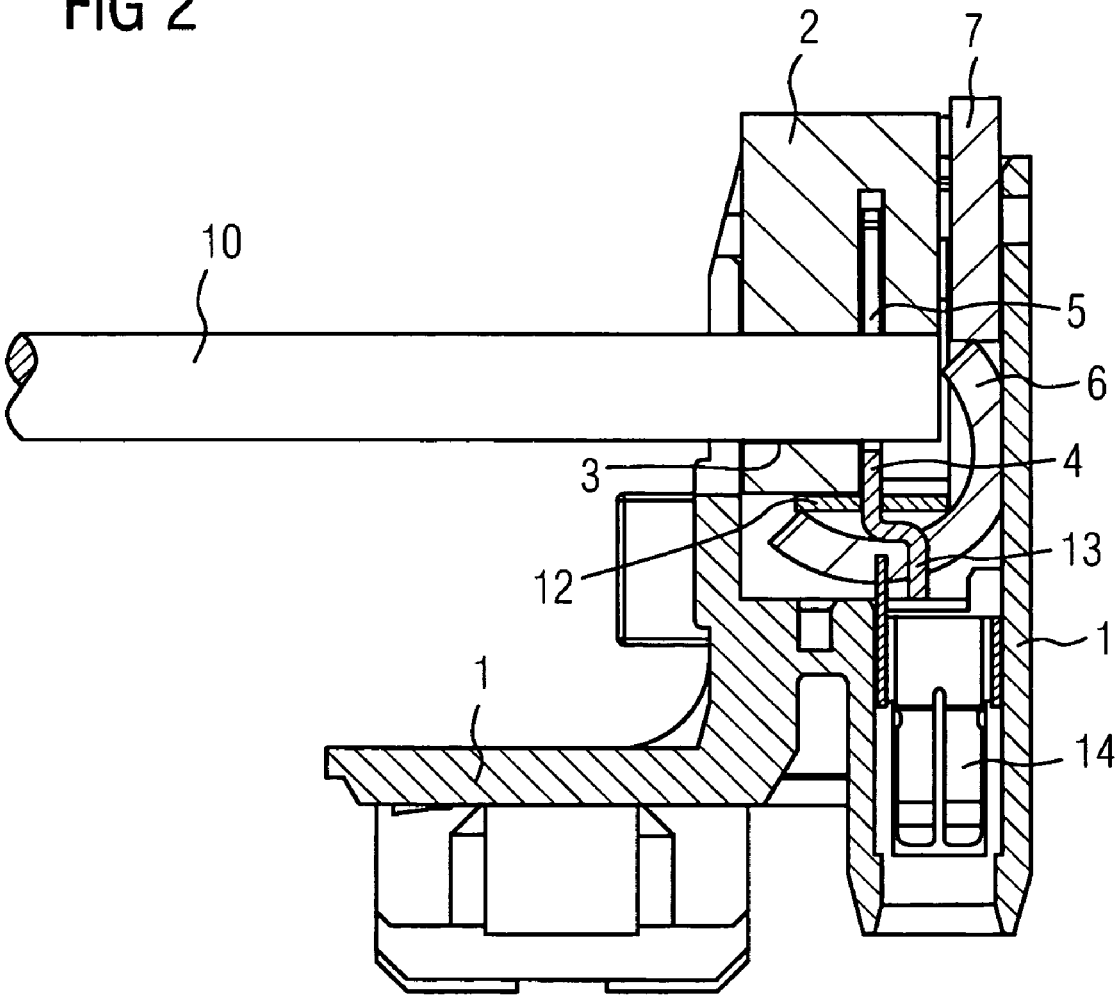
FIG. 2 shows a further insulation piercing connecting device in the closed state.

FIG. 2 shows a further exemplary embodiment of an insulation piercing connecting device. The insulation piercing connecting device is shown in the closed state in FIG. 2. Elements of the insulation piercing connecting device having the same function are designated by the same reference numerals in FIG. 2 and FIG. 1, even if the structural embodiment is different in each case. The closing element 2 has a receptacle area 3. In this case the receptacle area 3 is configured in such a way that an electrical conductor 10 can be introduced into the receptacle area 3 without bending. This has advantages particularly with relatively inflexible electrical conductors 10. In this case the direction in which the electrical conductor 10 is introduced into the receptacle area 3 is at right angles to the direction in which the closing element 2 and actuating element 7 move. The closing element 2 and actuating element 7 are disposed in the base body 1 of the insulation piercing connecting device in such a way that a linear movement is possible in each case. A linear movement of the closing element 2 is converted here by the correspondingly disposed and mounted rocker element 6 into a correspondingly opposite linear movement of the actuating element 7 and vice versa. In an open position of the device (not shown in FIG. 2) the conductor 10 can be introduced into the receptacle area 3 of the closing element 2. Once the electrical conductor 10 has been fully introduced, in order for the electrical conductor 10 to make electrical contact the closing element 2 is moved linearly downward together with the electrical conductor 10 contained in the receptacle area 3. With the movement of the receptacle area 3 downward, the insulation piercing connector 4 held in the base body 1 or, as the case may be, its contact region 5 penetrates into the receptacle area 3. In the process a cutting area 11 of the insulation piercing connector 4 penetrates the insulation of the electrical conductor 10 and thereby enables the contacting of the electrical conductor 10 by the contact region 5 of the insulation piercing connector 4. In the closed state of the device depicted in FIG. 2, the electrical conductor 10 has thus made reliable electrical contact. In order to enable the electrical contacting of the electrical conductor 10 to be broken and the electrical conductor 10 to be removed from the device, an opening action is initiated by appropriate actuation of the actuating element 7. During the opening action, the components actuating element 7, rocker element 6 and closing element 2 move in the opposite direction compared to the previously described closing action.

FIG. 3 shows a perspective view of an insulation piercing connector 4. The elements having the same function of the insulation piercing connectors 4 integrated in the devices according to FIG. 1 and FIG. 2 are designated by the same reference numerals in each case in FIGS. 1, 2 and 3. The insulation piercing connector 4 has a cutting area 11 and a contact region 5. The cutting area 11 serves for example to penetrate an insulation of an electrical conductor, whereas the contact region 5 serves to establish electrical contact with the inner conductor(s) of an electrical conductor. In order to attain the necessary pressure for piercing the insulation by means of the cutting areas 11 or, as the case may be, for establishing electrical contact with the inner conductor(s) by means of the contact region 5, the tongue-shaped parts of the cutting area 11 or the contact region 5 are pressed against each other by means of a spring-loaded element 12. In the exemplary embodiment according to FIG. 3 the spring-loaded element 12 is implemented as a steel overspring. The contact region 5 is electrically connected to contact elements 14 of the insulation piercing connector 4 via an intermediate element 13. The contact elements 14 are disposed in the base body 1 according to FIG. 1 and FIG. 2 in such a way that in each case a socket for the connection of electrical connecting means is formed.

The described device for contacting an electrical conductor is in particular what is known as a non-stripping connecting terminal. Currently a non-stripping connector based on the same connection principle requires approx. 60% more vertical installation space than a screw-type or spring-loaded connecting terminal. Whereas a commercially available screw-type or spring-loaded connecting terminal has a typical overall height of 12.2 mm, an insulation piercing connector normally has a typical overall height of 19.9 mm, i.e. it is significantly higher than a screw-type or spring-loaded connecting terminal. The insulation piercing connecting device proposed here, in contrast, can be implemented with an overall height of 12.2 mm. This means that the device can be accommodated in such a space-saving manner that in terms of installation height and width, with the same connectable conductor cross-sections, it can be fitted into the dimensions of a top connecting terminal (screw-type or spring-loaded technology). Owing to the rocker element 6 inserted under the insulation piercing connector 4, the actuating travel of the closing element 2 for connecting or, as the case may be, terminating the conductor is executed in the vertical direction. As a result it is possible to reduce the overall height of the insulation piercing connecting device to the dimensions of a typical screw-type or spring-loaded connecting terminal. The proposed device for contacting an electrical conductor is suitable on account of its compact design in particular for a 1- to n-row arrangement in a connecting terminal receptacle housing. An arrangement of said kind can be used for example as a front connector for modules used in industrial automation technology.

Compared with conventional connection techniques (using screw-type or spring-loaded connecting terminals), the insulation piercing connection technology offers a time saving of as much as 66% during wiring operations. Since it is a non-stripping connection technology, no special tool (e.g. stripping tool) is required for connecting electrical conductors.

To sum up, the invention relates to a device for contacting an electrical conductor, having a base body 1, having a closing element 2 with a receptacle area 3 for receiving the conductor, having an insulation piercing connector 4 held in the base body 1 with a contact region 5, wherein the closing element 2 is movable in a linear direction from an open position to a closed position relative to the base body 1, with the insulation piercing connector 4 being disposed such that its contact region 5 is located outside of the receptacle area 3 relative to the closing element 2 in the open position and inside the receptacle area 3 relative to the closing element 2 in the closed position. In order to improve the device it is proposed that a rocker element 6 and an actuating element 7 be provided, with the rocker element 6 being movably mounted in the base body 1 and disposed relative to the closing element 2 and actuating element 7 in such a way that a linear movement of the closing element 2 from the open position to the closed position can be converted into a linear movement of the actuating element 7 in the opposite direction and that a linear movement of the actuating element 7 can be converted into a linear movement of the closing element 2 from the closed position to the open position in the opposite direction.

The invention claimed is:

1. A device for contacting an electrical conductor, comprising:

a base body;

a closing element including a receptacle area for receiving the conductor, the closing element movable in a linear direction from an open position to a closed position relative to the base body;

an insulation piercing connector arranged in the base body and having a contact region, the insulation piercing connector positioned so the contact region is located outside the receptacle area relative to the closing element when in the open position and positioned so the contact region is located inside the receptacle area relative to the closing element when in the closed position; and a rocker element movably mounted in the base body and arranged near to the closing element and an actuating element such that a linear movement of the closing element from the open position to the closed position can be converted into a linear movement of the actuating element in the opposite direction and that a linear movement of the actuating element can be converted into a linear movement of the closing element from the closed position to the open position in the opposite direction.

2. The device as claimed in claim 1, wherein the insulation piercing connector contains a spring-loaded element.

3. The device as claimed in claim 1, wherein the device is provided for a 1-to-n-row arrangement in a connector receptacle housing.

4. The device as claimed in claim 1, wherein a cable storage space is provided ahead of the receptacle area.

5. A device for contacting an electrical conductor, comprising:

a base body;

a movable closing element including a receptacle area for receiving the conductor, the closing element adapted to move from a closed position to an open position and from the open position to the closed position;

an insulation piercing connector comprising a contact region and a spring arranged in the base body, the contact region located outside of the receptacle area near to the closing element when in the open position, and the contact region located inside the receptacle area near to the closing element when in the closed position;

a movable rocker element arranged in the base body; and an actuating element operatively associated with the movable rocker element in the base body such that the movement of the closing element is converted to a movement of the actuating element and the movement of the actuating element is converted to a movement of the closing element.

6. The device as claimed in claim 5, wherein movement of the closing element and the actuating element is linear.

7. The device as claimed in claim 6, wherein the actuating element moves in a direction opposite that the closing element moves.

8. The device as claimed in claim 6, wherein the actuating element moves in a direction perpendicular to the direction of movement of the closing element.

9. The device as claimed in claim 5, wherein the receptacle allows for the introduction of the conductor without bending the conductor.

10. The device as claimed in claim 5, wherein the receptacle allows for the introduction of the conductor with a first change of direction of the conductor.

11. The device as claimed in claim 10, wherein the receptacle allows for the introduction of the conductor with a second change of direction of the conductor.

12. The device as claimed in claim 5, further comprising a cable storage space for protecting the conductor.

13. The device as claimed in claim 5, wherein the device allows for a 1-to-n-row arrangement in a connector receptacle housing.

14. The device as claimed in claim 5, wherein the receptacle is penetrated by the insulation piercing connector when the closing element is closed thereby allowing physical and electrical contact of the conductor to the contact region.

* * * * *